US006349190B1

(12) United States Patent
Liu et al.

(10) Patent No.: US 6,349,190 B1
(45) Date of Patent: Feb. 19, 2002

(54) LOW COST PROCESS MULTICOLOR IMAGE REPRODUCTION MACHINE

(75) Inventors: Chu-heng Liu, Penfield; Weizhong Zhao, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/666,040

(22) Filed: Sep. 20, 2000

(51) Int. Cl.[7] ..... G03G 15/01; G03G 15/10

(52) U.S. Cl. ..... 399/223; 399/227; 399/233; 399/237; 399/302

(58) Field of Search ..... 399/223, 226, 399/227, 233, 237, 302, 308, 264

(56) References Cited

U.S. PATENT DOCUMENTS 5,596,396 A * 1/1997 Landa et al. ..... 399/237
5,815,783 A * 9/1998 Lior et al. ..... 399/302
5,826,147 A * 10/1998 Liu et al. ..... 399/237
5,937,248 A * 8/1999 Liu et al. ..... 399/237
5,966,570 A * 10/1999 Till et al. ..... 399/237
5,991,582 A * 11/1999 Liu et al. ..... 399/237
6,002,907 A * 12/1999 Berkes ..... 399/302 X
6,006,061 A * 12/1999 Liu et al. ..... 399/237 X
6,181,901 B1 * 1/2001 Zhao et al. ..... 399/223
6,185,399 B1 * 2/2001 Zhao et al. ..... 399/223
6,246,843 B1 * 6/2001 Nanataki et al.

FOREIGN PATENT DOCUMENTS

JP 8-194360 * 7/1996
JP 10-232571 * 9/1998

* cited by examiner

*Primary Examiner*—Susan S. Y. Lee
(74) *Attorney, Agent, or Firm*—Tallam I. Nguti

(57) ABSTRACT

A low cost process multicolor image reproduction machine includes a rotatable endless toner image receiving and transfer member for cyclically building up a multicolor image from a plural number of received color separation toner images; a sheet handling system including a back up roller defining a toner image transfer nip against the rotatable endless toner image receiving and transfer member; a rotatable photoreceptor member forming a contact electrostatic printing (CEP) nip with the rotatable endless toner image receiving and transfer member for separating toner image areas from toner background areas of a color separation toner image formed on the photoreceptor member; imaging devices for cyclically forming a plural number of color separation toner images on the photoreceptor member, and a controller for controlling formation of, and build up into a multicolor toner image, of the plural number of color separation images, as well as, transfer of the multicolor toner image onto a copy sheet.

8 Claims, 2 Drawing Sheets

LOW COST PROCESS MULTICOLOR IMAGE REPRODUCTION MACHINE

BACKGROUND OF THE INVENTION

This invention relates generally to electrostatography, and more particularly, concerns a low cost process multicolor image reproduction machine.

Generally, processes for electrostatographic copying and printing are initiated by selectively charging and/or discharging a charge receptive imaging member in accordance with an original input document or an imaging signal, generating an electrostatic latent image on the imaging member. This latent image is subsequently developed into a visible image by a process in which charged developing material is deposited onto the surface of the latent image bearing member, wherein charged solids in the developing material adhere to image areas of the latent image. The developing material typically comprises carrier granules having charged marking or toner solids adhering triboelectrically thereto, wherein the toner solids are electrostatically attracted from the carrier granules to the latent image areas to create a powder toner image on the imaging member.

Alternatively, the developing material may comprise a liquid developing material comprising a carrier liquid having pigmented marking solids (or so-called toner solids) and charge director materials dispersed and/or dissolved therein (so-called carrier liquid), wherein the liquid developing material is applied to the latent image bearing imaging member with the marking solids being attracted to the image areas of the latent image to form a developed liquid toner image. Regardless of the type of developing material employed, the charged toner or marking solids of the developing material are electrostatically attracted to the latent image to form a visible developed image corresponding to the latent image on the imaging member.

The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the imaging member or the nature of the latent image bearing member itself.

As described hereinabove, the typical electrostatographic printing process includes a conventional development step whereby developing material including charged marking or toner solids is physically transported into contact with the imaging member so as to selectively adhere to the latent image areas thereon in an image-wise configuration. Development of the latent image is usually accomplished by electrical attraction of charged toner or marking solids to the image areas of the latent image. The development process is most effectively accomplished when the solids carry electrical charges opposite in polarity to the latent image charges, with the amount of toner or marking solids attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

The process described above is suitable for producing monochrome or single color toner images. Multicolor toner images can also be produced using anyone of several well known methods representing variations from the monochrome or single color process.

In general, to produce multicolor images, different color components of a composite color image are formed and then put together in registration to achieve the composite color image. One multicolor image production method, for example, involves a process utilizing a plurality of different color toner development units, a single photoreceptor, and a multiple image frames single pass approach in which the monochrome or single color process is repeated for three or four cycles. In each cycle a component latent image of a composite multicolor final color is formed, and a toner of a different color is used to develop the component latent image.

Each developed component image as such is then transferred to the copy sheet. The process is repeated, for example, for cyan, magenta, yellow and black toner particles, with each color toner component image being sequentially transferred to the copy sheet in superimposed registration with the toner image previously transferred thereto. In this way, several toner component images, as are in the composite image, are transferred sequentially to the copy sheet, and can then be heated and permanently fused to the sheet.

A second method for producing color copies involves what is referred to as the tandem method which utilizes a plurality of independent imaging units for forming and developing latent component images, and a moving image receiving member such as an intermediate transfer roller or belt. In this method, the toned or developed component images from the imaging units are transferred in superimposed registration with one another to the intermediate roller or belt, thereby forming the multicolor composite image on the belt or roller. The composite image then can be transferred in one step to a sheet of copy paper for subsequent fusing.

A third method for producing color copies involves a single frame, single pass Recharge, Expose, and Develop (REaD) process. The REaD process uses a single photoreceptor, a single image frame thereon, and four imaging units each including imagewise exposure means and a development station containing a different color toner of cyan, magenta, yellow or black.

A composite subtractive multicolor image can thus be produced in a single pass, and on the single frame by charging, exposing and developing, then recharging, exposing and developing again utilizing this Recharge, Expose, and Develop (REaD) process architecture. In this process, digital version of the original or document is created pixel by pixel at a computer workstation or by a scanner. When created by scanning, light reflected from the original or document is first converted into an electrical signal by a raster input scanner (RIS), subjected to image processing, then reconverted into a light, pixel by pixel, by a raster output scanner (ROS).

In either case, the ROS exposes the charged photoconductive surface to record a latent image thereon corresponding to the subtractive color of one of the colors of the appropriately colored toner particles at a first development station. The photoconductive surface with the developed image thereon is recharged and re-exposed to record a latent image thereon corresponding to the subtractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original. The REaD process can also be performed as a multiple pass process.

Machines for carrying out each of the conventional multicolor processes as described above, typically include a large number of expensive components, and a long cycle, and hence a long process, which together result in an undesirably high cost per copy of each multicolor image they produce.

There is therefore a need for a multicolor image reproduction machine that has very few components and a relatively very short cycle, thus resulting in a cheaper (relative to cost of conventional) cost per copy produced.

SUMMARY OF THE INVENTION

In accordance with the present invention, there is provided a low cost process multicolor image reproduction machine includes a rotatable endless toner image receiving and transfer member for cyclically building up a multicolor image from a plural number of received color separation toner images; a sheet handling system including a back up roller defining a toner image transfer nip against the rotatable endless toner image receiving and transfer member; a rotatable photoreceptor member forming a contact electrostatic printing (CEP) nip with the rotatable endless toner image receiving and transfer member for separating toner image areas from toner background areas of a color separation toner image formed on the photoreceptor member; imaging devices for cyclically forming a plural number of color separation toner images on the photoreceptor member, and a controller for controlling formation of, and build up into a multicolor toner image, of the plural number of color separation images, as well as, transfer of the multicolor toner image onto a copy sheet.

BRIEF DESCRIPTION OF THE DRAWINGS

These and other aspects of the present invention will become apparent from the following description in conjunction with the accompanying drawings in which.

DETAILED DESCRIPTION OF THE INVENTION

While the following description will be directed to a liquid immersion development (LID) type multicolor image reproduction machine, it is understood that the present invention contemplates the use of various alternative embodiments for the initial development of a toner image, as are well known in the art of electrostatographic copying and printing, including, for example, but not limited to, liquid toner development and dry toner development. On the contrary, the following description is intended to cover all alternatives, modifications, and equivalents, as may be included within the spirit and scope of the invention as defined by the appended claims.

Figure 1:
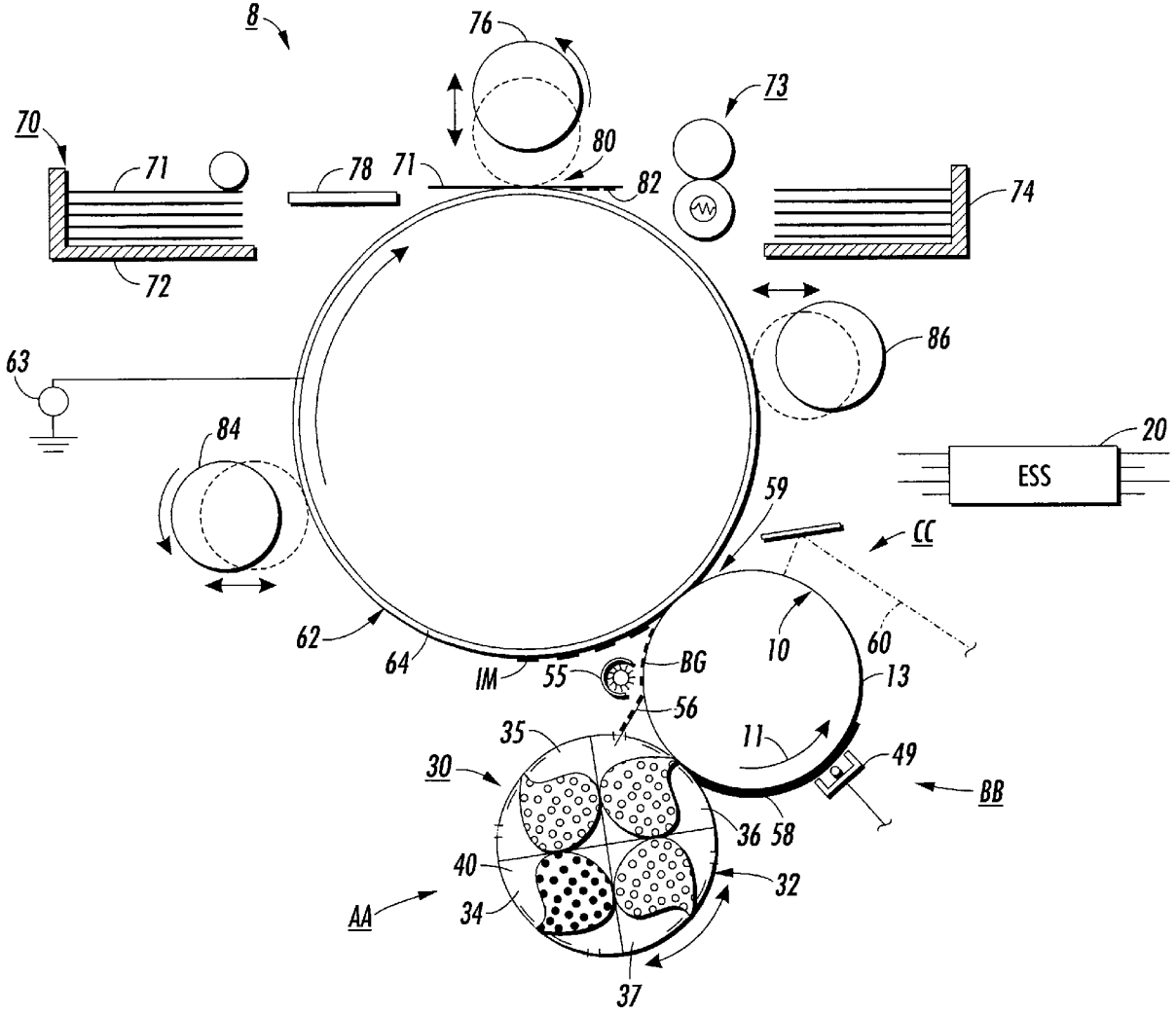
FIG. 1 is a schematic illustration of the low cost process multicolor image reproduction machine of the present invention.

Referring now to FIG. 1, an exemplary low cost process multicolor image reproduction machine, (such as a liquid immersion development (LID) machine), of the present invention for forming multicolor toner images in accordance with the present invention, is shown generally as 8. As shown, the machine 8 includes a series of assemblies of operatively associated image forming elements in accordance with the present invention, including an imaging member 10. Imaging member 10 includes an imaging surface 13 of any type capable of having a color electrostatic latent image formed thereon. An exemplary imaging member 10 may include a typical photoconductor or other photoreceptive component of the type known to those of skill in the art in electrophotography, wherein an imageable surface having photoconductive properties is supported on a conductive support substrate.

Although the following description will be directed to a photoconductive imaging member, it will be understood that the present invention contemplates the use of various alternative embodiments for an imaging member as are well known in the art of electrostatographic printing, including, for example, but not limited to, non-photosensitive imaging members such as a dielectric charge retaining member of the type used in ionographic printing machines, or electroded substructures capable of generating charged latent images.

As illustrated, photoreceptor 10 is rotated, so as to transport the surface 13 thereof in a process direction indicated by arrow 11, for implementing a series of image forming steps in accordance with the present invention. Initially, the surface 13 is moved to a toner coating station AA where a developer material supply and coating mechanism 30 applies a desired thin layer or cake 58 of a selected color of developer material.

Figure 2:
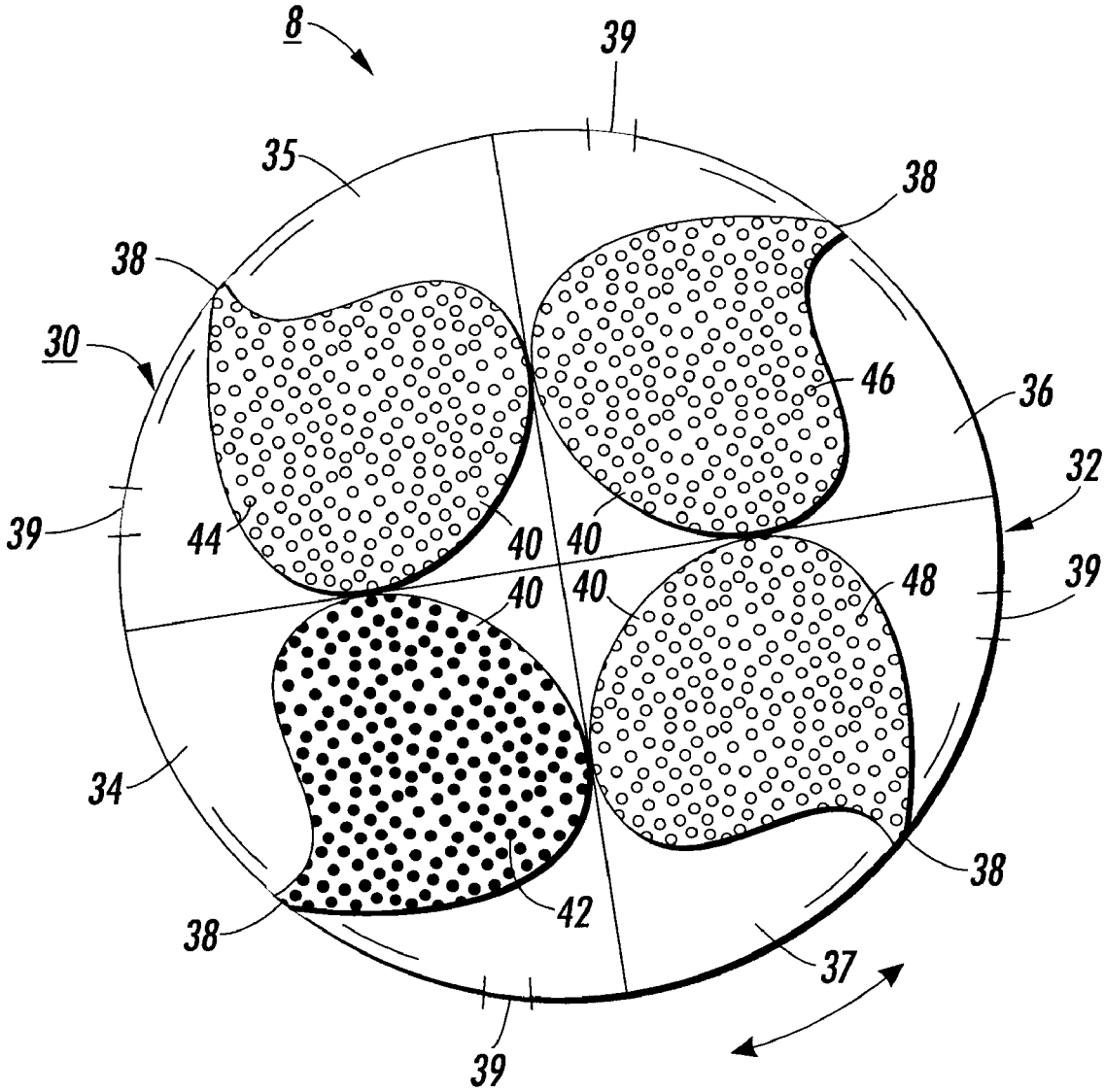
FIG. 2 is an enlarged illustration of the developer material supply and coating mechanism of the low cost process multicolor image reproduction machine of FIG. 1 in accordance with the present invention.

As shown in FIGS. 1 and 2, the developer material supply and coating mechanism 30 for example includes a generally cylindrical cartridge member 32 that is rotatable as shown, and that has a plural number of segments 34, 35, 36, 37 thereto. Each segment of the plurality number of segments 34, 35, 36, 37 includes a chamber containing a particular desired color of developer materials 42, 44, 46, and 48. Each segment 34, 35, 36, 37 also includes an application nozzle 38 that is controllably closed, or open for uniformly applying onto the surface 13, a thin layer or cake 58 of the particular desired color of developer materials 42, 44, 46, and 48. For example, a nozzle 38 of one of the segments 34, 35, 36, 37 is adapted to apply the thin layer 58 of relatively high toner solids content liquid developer material of a desired color onto the surface 13. As further shown, each segment includes a recycling aperture 39 that is controllably closed, or open for receiving spent or waste background developer material coming from the surface 13, after image development and transfer in accordance with the present invention.

In the illustrative exemplary LID machine of the present invention, the thin layer or cake 58 of relatively high toner solids content liquid developer material of a particular desired color preferably comprises a relatively high concentration of charged toner particles of such color dispersed in a liquid carrier agent. At the coating station, a nozzle 38 of one of the segments 34, 35, 36, 37 of the developer material supply and coating mechanism 30, uniformly applies the thin layer 58 of relatively high toner solids content liquid developer material of a desired color onto the surface 13. Thus each nozzle 38 is suitable for bringing high toner solids content into pressure contact with the entire surface 13 of the image bearing member or photoreceptor 10, thereby creating the uniform thin layer or cake 58 of charged toner particles. During each application, the particular liquid developer material 42, 44, 46, or 48 is released to the nozzle 38 of the applying segment for such application.

After the liquid developer material layer or toner cake 58 of the particular color has been formed as above on the surface 13, it is transported next to a charging station BB.

At charging station BB, a charging device, generally identified by reference numeral 49, is provided for uniformly charging the cake 58 of toner particles of a particular color and the photoreceptor, by injecting ions thereinto. The charging device 49 is used thus to spray ions toward the layer 58, wherein the ions travel through the layer 58 and either generate a charge on the toner particles therein or neutralize counter ions which may be present in the developer material forming the layer 58 or land on the photoreceptor surface. It will be understood that various charging devices, such as charge rollers, charge brushes and the like, as well as inductive and semiconductive charge devices, among other devices which are well known in the art, may be utilized at the charging station BB for applying a substantially uniform charge potential to the layer 58.

Although in accordance with the present invention the developer material coating station AAA for applying the layer 58 on the surface 13 has been shown as preceding the charging station BB and charging device 49, it is understood that these two stations AA, BB can be switched. In which case, the surface 13 will be uniformly charged by the charging device 49, prior to being uniformly coated with the layer or cake 58 of developer material.

In either case, after portions of the photoreceptor surface 13 have been coated and charged or charged and coated as above, they are advanced to an image exposure assembly CC that includes an exposure device identified generally by reference numeral 60. The exposure device 60 is controlled by an electronic control subsystem (ESS) 20, and projects onto the charged layer or cake 58 a light image corresponding to an input image being reproduced. The projected light image selectively dissipates charge in some portions of the uniformly charged photoreceptor and the layer or cake 58, thus recording therein image areas defined by a first charge potential, and non-image or background areas defined by a second charge potential.

The image exposure assembly 60 may incorporate various optical image formation and projection components as are known in the art. For example, it may include various well known light lens apparatus or digital scanning systems for forming and projecting an image from an original input document onto the surface of the photoreceptor 10. Alternatively, various other electronic devices available in the art may be utilized for generating electronic information to create the electrostatic latent image on the imaging member.

The ESS 20 is preferably a self-contained, dedicated mini-computer having a central processor unit (CPU), electronic storage, and a display or user interface (UI). The ESS 20 as such is the control system which with the help of sensors and connectors, as well as, a dedicated processor or controller, can read, capture, prepare and manage the image data flow. In addition, the ESS 20 is also the main multitasking processor for operating and controlling all printing operations and all of the other machine subsystems (to be described below) of the present invention.

Referring still to the drawing (FIG. 1), the low cost process multicolor image reproduction machine 8 also includes a toner image receiving and transfer member in the form of a contact electrostatic printing (CEP) biased member 62. As shown, the (CEP) biased member 62 forms a CEP toner image process nip 59 with the imaging member or photoreceptor 10. In addition, the (CEP) biased member 62 preferably includes a conductive and conformable outer layer 64 that is biased by a bias source 63 coupled thereto, and that forms the toner image CEP process nip 59 with the surface 13 of the photoreceptor 10. Specifically, within the nip 59, the CEP biased member 62 and the photoreceptor 10, operate to sandwich the toner layer or cake 58 of a particular desired color of developer material 42, 44, 46, 48, thereby generating image-wise electric fields across portions of the layer 58 as they pass through the process nip 59.

As disclosed in commonly assigned U.S. Pat. No. 5,991,582 the process nip 59 is defined by a nip entrance, and a nip exit, wherein the nip entrance operatively applies compressive stress forces to the layer 58, and wherein the nip exit is operative to apply tensile stress forces to the layer 58, thereby causing image-wise separation of the toner solids corresponding to image areas IM, and to background areas BG of the layer 58. This happens because within the nip 59, the bias source 63 cooperates with the image pattern in the layer 58 to generate image-wise electric fields within the nip 59. Since the CEP biased member 62 has a conformable surface layer 64, this permits such layer 64 to conform to the surface 13 within the nip 59.

The electrical biasing source 63 is coupled to the CEP biased member 62 for applying an electrical bias thereto in order to generate electrostatic fields between the surface of CEP member 62 and the toner layer 58 (consisting of image areas and background areas thereof) on the photoreceptor 10. These generated electrostatic fields include field lines moving towards opposite directions depending on whether they are over image areas or over background areas of the charged and imagewise exposed layer 58. Thus the field lines are either moving towards the surface of the photoreceptor 10, or towards the surface of biased CEP member 62. Importantly, this difference in direction of the field lines advantageously will enable easy simultaneous separation of toner solids IM in the image areas from toner solids BG in the background areas of the toner image at the exit of the nip 59.

As shown, after each layer 58 of a desired color of developer material is separated as above into image areas IM, and background areas BG, the background areas BG stay on the surface 13. For removing them from the surface 13, the machine 8 includes a cleaning mechanism such as a blade 56 which is mounted so as to aligned with the recycling aperture 39 of each segment 34, 35, 36, 37, while the nozzle 38 of such segment is in the layer applying position. As discussed above, the recycling aperture 39 of each segment can be opened to receive spent or background area toner in such position, and then be closed before such segment is rotated away from the layer applying position, in favor of another segment with a different color developer material. A flooding lamp 55 is also provided for neutralizing residual charges on the surface 13 as it is being cleaned by the blade 56.

With continued reference to the drawing (FIG. 1), the low cost process multicolor image reproduction machine 8 further includes a sheet handling assembly 70 that includes a sheet supply source 72, a fusing assembly 73, an output tray 74, and a back up roller 76 for defining a copy sheet path 78. As shown, the copy sheet path 78 is variable as defined by the back up roller 76. As such, the back up roller 76 has a first position away from the rotatable endless toner image receiving, and transfer member, that is with the biased CEP member 62. The back up roller 76 also has a second position as shown, in nip contact with the rotatable endless toner image receiving and transfer member or biased CEP member 62, thereby forming a toner image transfer nip 80 for transferring a toner image from the biased CEP member 62.

Therefore, with the control of the ESS 20, the back up roller 76 can be moved from the first position into the second position to form the toner image transfer nip 80, and a copy sheet fed into the nip 80, to receive a toner image from the biased CEP member 62. In particular, the ESS or controller 20 is suitable for controlling the sheet handling assembly 70 to timely supply a copy sheet 71 from the copy sheet source 72, and to timely move the back up roller 76 from its first position to its second position, for receiving onto the copy sheet 71, a built up multicolor toner image 82 from the rotatable endless toner image receiving and transfer member or biased CEP member 62.

As further shown, the low cost process multicolor image reproduction machine 8 includes an image conditioning device 84 and a cleaning device 86. Each of these devices as shown has two positions, the first position being away from the biased CEP member 62, and the second position being in nip and operating contact with the biased CEP member 62.

The low cost process multicolor image reproduction machine 8 as such has very few components and a relatively very short cycle. It is therefore suitable for making multicolor toner images that are relatively cheaper (relative to cost of conventional machines). To make an N color multicolor image (where N can be 2, 3 or 4), the machine 8 under the control of the ESS 20 will first be in a cycling mode. In the cycling mode, the biased CEP member 62 is set in nip contact with the photoreceptor 10 thereby forming the process nip 59 for separating toner image areas IM from toner background areas BG of a layer 58 of a particular color of toner particles. In the cycling mode, the image conditioning device 84, the back up roller 76 and the cleaning device 86 will each be in their first positions away from the biased CEP member 62.

The machine is thus ready to use N different color developer materials of the developer materials 42, 44, 46, 48, one per rotation of the photoreceptor 10, to make N layers 58, and process such N layers in N cycles through the process nip 59. The exposure device 60 imagewise exposes each different N color of developer material layer 58 to a input image of that color's color separation image. The resulting image areas IM each cycle thus form on the biased CEP member 62 a color separation toner image. One such color separation toner image is thus formed through a first cycle. In subsequent cycles up to and including the Nth, cycle, subsequent color separation toner images are similarly formed in registration on the surface of the biased CEP member 62, thereby building up, from such color separation toner images, a multicolor toner image on the surface of the biased CEP member 62.

As the N cycles end, with portions of an N multicolor image on the surface of the biased CEP member 62, the machine 8 will be put in a toner image transfer mode. In the transfer mode, the image conditioning device 84, the back up roller 76 and the cleaning device 86 are each set in their second positions in nip and operative contact with the biased CEP member 62. Thus as portions of the last color separation toner image are being formed in registration on the surface of the biased CEP member 62, they are subsequently conditioned and then transferred within the nip 80 onto a fed copy sheet 71. Such portions of the surface of the biased CEP member 62 are thereafter immediately cleaned by the cleaning device 86, to ready the such surface for formation of a next multicolor toner image, after the machine 8 is reset to the cycling mode.

The image conditioning device 84, which is retractable, is mounted downstream of the toner image separating nip for contacting, compacting and removing carrier liquid from toner images on the rotatable endless toner image receiving and transfer member or biased CEP member 62. The cleaning device 86, which is also retractable, is mounted upstream of the toner image transfer nip for selectively contacting and cleaning the rotatable endless toner image receiving and transfer member or biased CEP member 62, following transfer of the built up multicolor toner image from the biased CEP member 62 onto the copy sheet 71.

The cleaning mechanism or blade 55 is mounted into cleaning contact with the surface 13 at a point downstream of the contact electrostatic printing nip 59, relative to movement of the rotatable photoreceptor member 10. As such, it suitable for removing toner background areas from the surface 13 prior to the surface 13 receiving a new coat or layer 58 of another desired color toner thereon.

Accordingly, the machine 8 can make, 2, 3 and 4 color multicolor images 82 using different color developer materials such as Cyan Magenta, Yellow and Black.

As can be seen, there has been provided a low cost process multicolor image reproduction machine includes a rotatable endless toner image receiving and transfer member for cyclically building up a multicolor image from a plural number of received color separation toner images; a sheet handling system including a back up roller defining a toner image transfer nip against the rotatable endless toner image receiving and transfer member; a rotatable photoreceptor member forming a contact electrostatic printing (CEP) nip with the rotatable endless toner image receiving and transfer member for separating toner image areas from toner background areas of a color separation toner image formed on the photoreceptor member; imaging devices for cyclically forming a plural number of color separation toner images on the photoreceptor member, and a controller for controlling formation of, and build up into a multicolor toner image, of the plural number of color separation images, as well as, transfer of the multicolor toner image onto a copy sheet.

While the embodiment of the present invention disclosed herein is preferred, it will be appreciated from this teaching that various alternative, modifications, variations or improvements therein may be made by those skilled in the art, which are intended to be encompassed by the following claims:

1. A low cost process multicolor image reproduction machine comprising:

(a) a rotatable endless toner image receiving and transfer member;

(b) sheet handling means including a back up roller for defining a copy sheet path, said back up roller having a first position, and a second position defining a toner image transfer nip against said rotatable endless toner image receiving and transfer member;

(c) a rotatable photoreceptor member forming a contact electrostatic printing nip with said rotatable endless toner image receiving and transfer member, for separating toner image areas from toner background areas of a color separation toner image on said photoreceptor member;

(d) imaging means for forming the color separation toner image on said photoreceptor member, said imaging means including a developer material supply and coating mechanism having a plural number of different color developer materials including toner for forming a layer of a desired color of toner on said photoreceptor member, a charging device for uniformly charging said layer of the desired color of toner, and an exposure device for imagewise exposing said charged layer to a light pattern, of a color separation input image, thereby forming said toner image areas and toner background areas of each desired color separation of a multicolor image to be separated within said contact electrostatic printing nip; and (e) a controller for controlling said sheet handling means to supply a copy sheet and to move said back up roller from said first position into said second position, and for controlling build up of color separation toner images into a multicolor toner image on said rotatable endless toner image receiving and transfer member.

2. The low cost process multicolor image reproduction machine of claim 1, including an image conditioning device mounted downstream of said toner image transfer nip for contacting, compacting and removing carrier liquid from toner images on said rotatable endless toner image receiving and transfer member.

3. The low cost process multicolor image reproduction machine of claim 1, including a retractable cleaning device mounted downstream of said toner image transfer nip for selectively contacting and cleaning said rotatable endless toner image receiving and transfer member following transfer of the built up color separation toner image onto a copy sheet.

4. The low cost process multicolor image reproduction machine of claim 1, wherein said developer material supply and coating mechanism includes a generally rotatable cylindrical member.

5. The low cost process multicolor image reproduction machine of claim 1, including a cleaning apparatus mounted into cleanup contact with said rotatable photoreceptor member downstream of said contact electrostatic printing nip relative to movement of said rotatable photoreceptor, for removing toner background areas from said rotatable photoreceptor member and for cleaning said rotatable photoreceptor member prior to forming of a new coat of a desired color toner thereon.

6. The low cost process multicolor image reproduction machine of claim 4, wherein said rotatable cylindrical member includes a plural number of segments, and each segment of said plural number of segments has a chamber containing a desired color of developer materials.

7. The low cost process multicolor image reproduction machine of claim 6, wherein said each segment includes an application nozzle that is controllably openable for uniformly applying onto said photoreceptor member, a thin layer of said desired color of developer materials.

8. The low cost process multicolor image reproduction machine of claim 6, wherein said each segment includes a recycling aperture that is controllably openable for receiving spent background developer material coming from said photoreceptor member, after image areas and background areas separation within said contact electrostatic printing nip.

* * * * *